United States Patent [19]

Semple

[11] 4,206,874

[45] Jun. 10, 1980

[54] HEATING

[75] Inventor: Joseph W. Semple, Boylston, Mass.

[73] Assignee: NEGEA Energy Products, Inc., Cambridge, Mass.

[21] Appl. No.: 867,713

[22] Filed: Jan. 9, 1978

[51] Int. Cl.[2] ..... F24D 3/08

[52] U.S. Cl. ..... 237/8 C; 237/63

[58] Field of Search ..... 237/8 R, 8 C, 63; 236/25 A

[56] References Cited

U.S. PATENT DOCUMENTS

| | | | |
|---|---|---|---|
| 817,855 | 4/1906 | Jane | 237/8 R |
| 1,029,300 | 6/1912 | Jones | 237/8 R |
| 1,206,789 | 12/1916 | Adams | 237/8 R |
| 1,959,933 | 5/1934 | Simsohn | 122/32 |
| 2,481,297 | 9/1949 | Eggert | 237/8 |
| 2,721,706 | 10/1955 | Schoerner | 237/8 R |
| 2,781,174 | 2/1957 | Smith | 237/8 R |
| 2,889,116 | 6/1959 | MacCracken et al. | 237/8 R |
| 2,952,410 | 9/1960 | MacKay | 237/8R |
| 3,171,597 | 3/1965 | Baier | 237/19 |
| 3,544,005 | 12/1970 | Meier | 237/8 R |
| 3,896,992 | 7/1975 | Borovina et al. | 237/19 |
| 3,999,709 | 12/1976 | Estabrook | 237/8 R |
| 4,065,054 | 12/1977 | Meier | 237/8 R |

FOREIGN PATENT DOCUMENTS

| | | | |
|---|---|---|---|
| 1101724 | 3/1961 | Fed. Rep. of Germany | 237/8 C |

*Primary Examiner*—Albert J. Makay
*Assistant Examiner*—William E. Tapolcai, Jr.

[57] ABSTRACT

A heater system comprising a main water discharge and main water return adapted for connection to space or domestic hot water heating means, a main water heater operative for heating water flow therethrough and connected in series with a main pump, and a control system adapted for connection to the space or domestic water heating means and operative to actuate the pump and cause the heater to heat water passing therethrough in response to a signal from a thermostatic sensor in the space or domestic water heating means.

13 Claims, 4 Drawing Figures

FLOW ACTUATED HEATER
HOUSE HEATING ZONE C
HOUSE HEATING ZONE B
HOUSE HEATING ZONE A
HOT OUT
COLD IN
10
12
12-A
12-B
12-C
14
16
16-A
16-B
16-C
18
20
20-A
20-B
20-C
22-A
22-B
22-C
24-A
24-B
24-C
25
26
28
30
32
34
36
38
39
40
42
44
46
48
50
52
54
56
58
60
62
64
66
68
70
72
74
76
78
80
82
84
86

HEATING

This invention relates to heating.

It is principal object of the present invention to provide a fail-safe heater system that can be used with either new or existing home or commercial space heaters and domestic hot water heaters, requires little or no heated standby water, and will achieve energy savings on the order of 25 percent relative to heating equipment present commercially available. Other objects include providing such systems that can be constructed using conventional and readily available components, and that can replace existing warm air or hot water space heaters and will integrate with existing domestic hot water heaters and space heater distribution systems.

The invention is featured in a heater system comprising a main water discharge and main water return adapted for connection to space or domestic hot water heating means, a main water heater operative for heating water flowing therethrough and connected in series with a main pump, and a control system adapted for connection to the space or domestic water heating means and operative to actuate the pump and cause the heater to heat water passing therethrough in response to a signal from a thermostatic sensor in the space or domestic water heating means. In one aspect of the invention, a bypass conduit including an adjustable balance valve is connected across the main pump and heater in parallel with the main discharge and return. In another aspect, one safety control prevents water flowing in the main heater system from being heated by the heater when the temperature of water in the return is above one predetermined level, and a second safety control prevents the main pump from operating when the temperature of water in the discharge exceeds a second predetermined level. Preferred embodiments in which the heater system supplies heated water to both multi-zone space heating means connected between the discharge and return and domestic water heating means either connected in parallel with the multi-zone space heating means or to a heat exchanger between the main heater and discharge feature both aspects, have a low water storage capacity, and include control valves response to thermostatic sensors in each of the respective zones for permitting flow therethrough only when the sensed temperature therein falls below a predetermined level, and secondary system and hot water pumps as required.

Other objects, features and advantages will appear from the following detailed description of preferred embodiments of the invention, taken together with the attached drawings in which.

Figure 1:
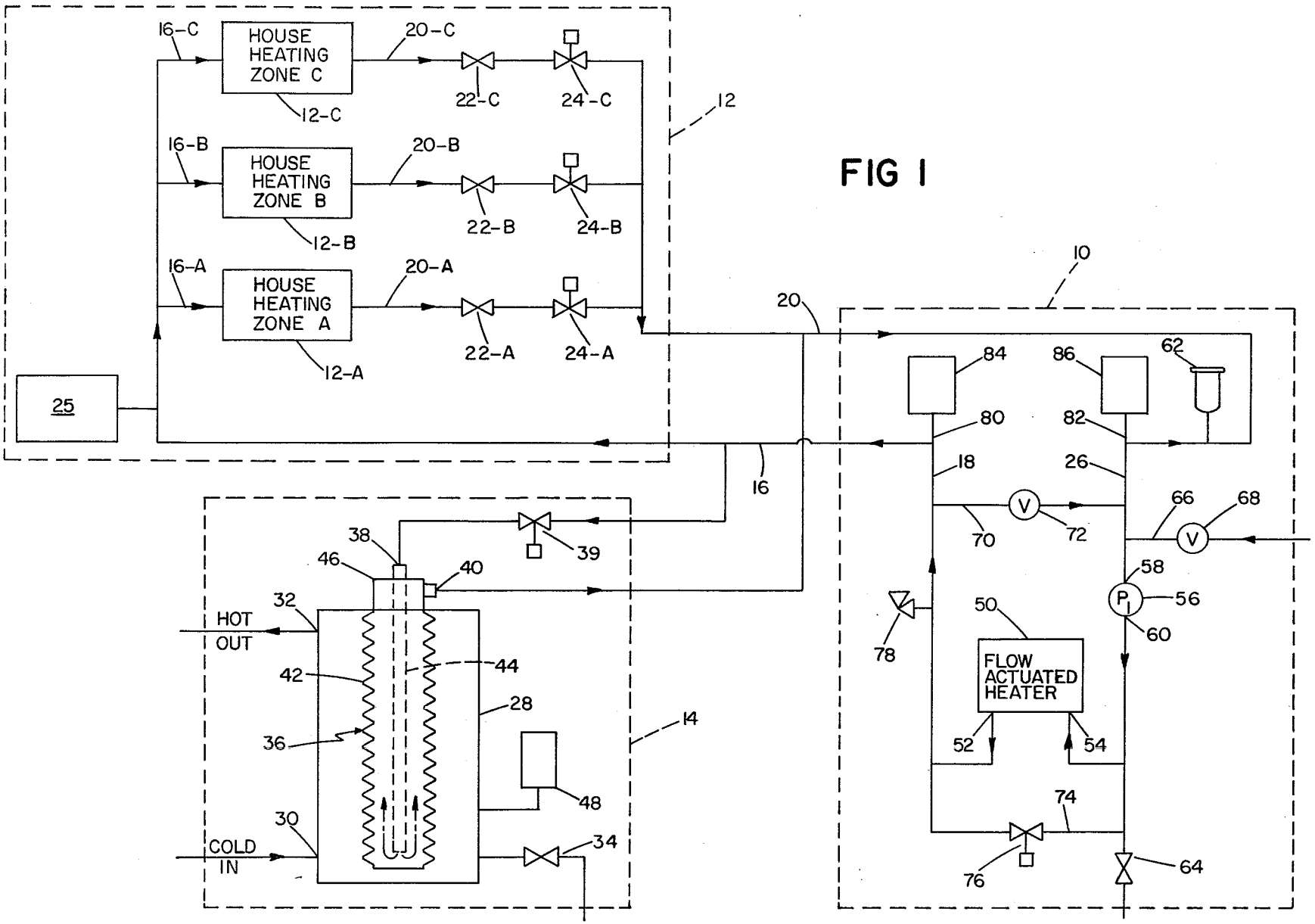
FIG. 1 is a schematic of a heater system constructed according to the present invention.

Referring now to FIG. 1, there is shown a space and water heater system, generally designated 10, for providing hot water to both a house space heating system 12 and a domestic hot water heating system 14. The house space heating system 12 may be of any conventional type in which hot water is used as a heat supply, including for example both hot water radiator and baseboard systems and hot air systems in which the air to be heated is passed through or over a hot water coil or other heat exchanger. In the embodiment shown, the two heating systems are connected to a systems inlet pipe 16 connected to the hot water discharge line 18 of heater system 10 and to a systems outlet pipe 20 connected to return line 26 of heater system 10.

Heating system 12 includes three heating zones, designated 12-A, 12-B and 12-C respectively, connected in parallel between systems inlet 16 and outlet 20. Each zone has its respective inlet 16-A, 16-B, 16-C connected through systems inlet 16 to discharge line 18, and its respective outlet 20-A, 20-B, 20-C connected through a respective conventional purge valve 22-A, 22-B, 22-C and zone flow control valve 24-A, 24-B and 24-C to systems outlet 20 and return line 26. A conventional expansion control tank 25 is connected to systems inlet 16 upstream of zone inlets 16-A, 16-B and 16-C.

Domestic hot water heating system 14 includes a generally conventional insulated storage tank 28 having a domestic cold water inlet 30, a domestic hot water outlet 32 and a drain cock 34. Water in the tank is heated by a heat exchanger, generally designated 36, having its inlet 38 connected through a flow control valve 39 to systems inlet 16 and its outlet 40 connected to systems outlet 20. In the illustrated embodiment, heat exchanger 36 comprises a pair of coaxial copper pipes or tubes extending vertically within tank 28. The outer tube 42 has a helically flared circumferential surface, as manufactured by Spiral Tubing Co. of New Britain, Conn., and is capped at its bottom. The inner pipe 44 has its lower end a short distance above the capped bottom of tube 42 and extends upwardly through a cap 46 at the top of tube 42 to provide inlet 38. Outlet 40 is in the side of cap 46. The temperature of water within the tank is monitored by a conventional aquastat 48.

Heater system 10 includes a main heater 50, preferably a Paloma Model PH-12 tankless gas hot water heater manufactured in Japan and sold in the United States through Paloma Industries of Chicago, Ill., having its main outlet 52 connected to return discharge line 18 and its main inlet 54 connected to return line 26. A pump 56, in the preferred embodiment a Grundfos type VP 26-64 F or other pump having a variable head control so that its output may be matched to the demands of the system, is provided in return line 26 with its inlet 58 serially connected to systems outlet 20 and its outlet 60 to heater inlet 54. A conventional automatic air vent 62 is attached to return line 26 upstream of pump 56. A drain cock 64 and a water inlet line 66 connected to the domestic cold water supply permit the heater system to be flushed, and an automatic pressure reducing valve 68 in inlet line 66 reduces the pressure of water entering the system to about 12 psig. A bypass conduit 70 including a balance valve 72, in the preferred embodiment an adjustable ball valve, is connected between discharge line 18 and return line 26 in parallel with main heater 50 and between it and systems inlet 16 and outlet 20. A safety bypass conduit 74 including a bypass control valve 76, as shown an Automag Model AA-3/4-25 normally open 24 volt D.C. control valve, is connected in parallel with and between the heater inlet 54 and outlet 52, and an ASME 30 psig. pressure relief valve 78 is connected to discharge line 18.

For sensing the temperature of water supplied to and returning from heating system 12 and 14, temperature control wells 80, 82 are provided, respectively, in discharge line 18 and return line 26. The sensor of an upper limit control 84 is connected to well 80, that of a lower limit control 86 to well 82. In the illustrated embodiment, upper limit control 84 is a Therm-O-Disc 11 H 11 safety switch manufactured by Therm-O-Disc, Inc. of Manfield, Ohio, and lower limit control 86 is a White Rodgers 11 CO6 safety switch.

Figure 2:
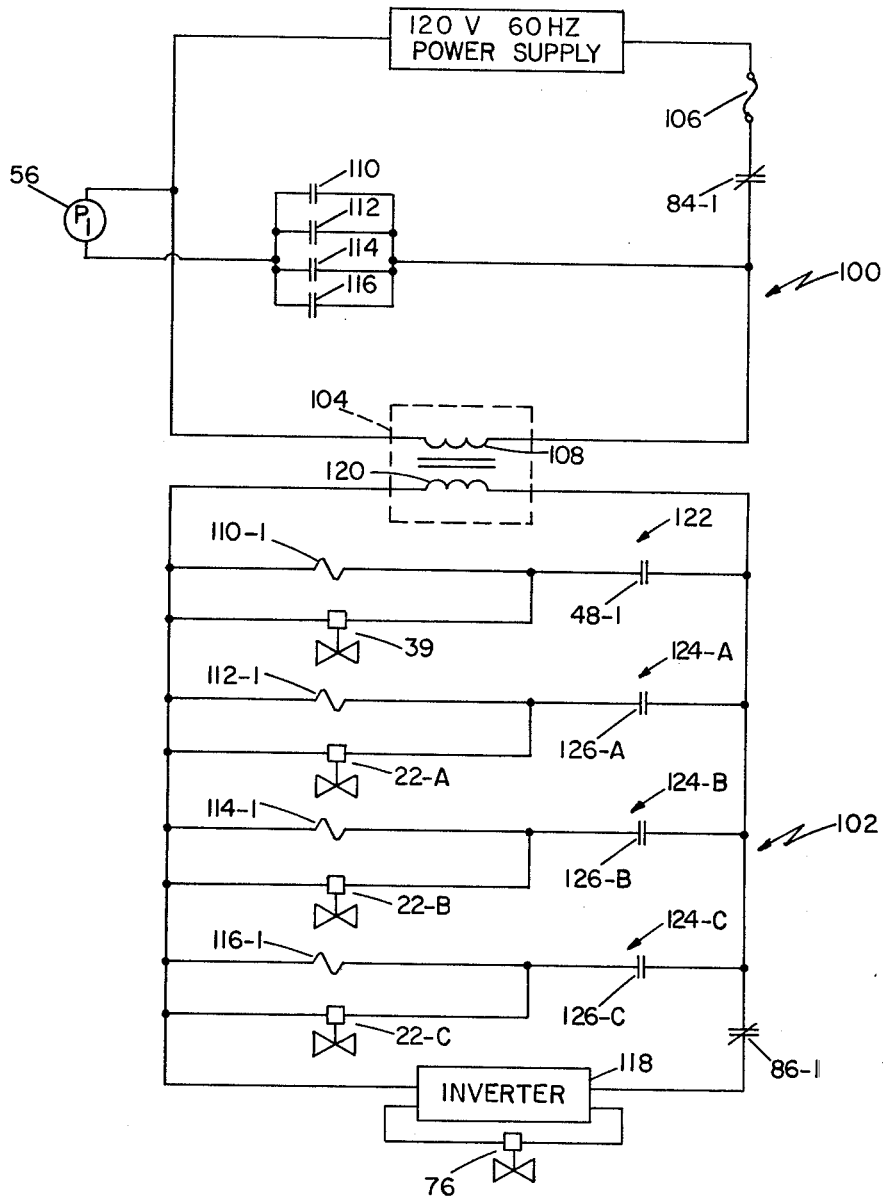
FIG. 2 is a schematic illustration of the controls of the system of FIG. 1.

FIG. 2 illustrates the electrical control system for the heating system of FIG. 1. As shown, the system is powered by conventional house current, a 120 volt, 60 Hz. power supply, and includes a 120 volt a.c. power loop, generally designated 100, and a 24 volt a.c. control loop, generally designated 102, coupled by a White Rodgers Model 810373 transformer 104. The power loop 100 includes the normally-closed switch 84-1 of upper limit control 84 and a 70 amp fuse 105 connected in series with the main winding 108 of transformer 104; and pump 56 connected in parallel with main winding 108 through the normally-open parallel-connected relay contacts of four Potter-Bromfield KVP 11A15-10 amp. double pole - double throw 24 volt relays, designated 110, 112, 114 and 116. In the control loop, the normally closed switch 86-1 of lower limit control 86 and a Semicon Corp. FWL B600 AC to DC inverter 118 are connected across the secondary winding 120 of transformer 104, with bypass control valve 76 connected to the d.c. side of inverter 118. Control loop 102 also includes four control circuits, designated 122, 124-A, 124-B and 124-C, connected in parallel with each other across winding 120 between it and inverter 118 and switch 86-1.

Circuit 122 controls the heating of water in hot water storage tank 28 and includes the switch 48-1 of aquastat 48 connected in series with parallel connected valve control valve 39 and the coil 110-1 of relay 110. Heating of the respective zones of space heater system 12 is similarly controlled by circuits 124-A, 124-B and 124-C, each of which is associated with a respective one of zones 12-A, 12-B and 12-C. Each of control circuits 124-A, 124-B, 124-C includes the thermostatic switch 126-A, 126-B, 126-C of the respective zone connected in series with the zone's control valve 22-A, 22-B, 22-C and the coil, 112-1, 114-1 or 116-1, of a respective one of relays 112, 114 and 116.

In operation, heater system 10 is activated by any one of the zones of house heating system 12 or by hot water system 121. If, for example, the temperature of water in domestic hot water tank 28 falls below a predetermined level, this drop in temperature is sensed by aquastat 48 and the normally open switch 48-1 of the aquastat is closed, thereby permitting current in circuit 122 of control loop 102 to flow through the control of valve 39 and relay 110-1. This flow of current opens normally-closed valve 39 and also energizes relay coil 110-1 thereby closing normally open contacts 110 in power loop 100 and energizing pump 56.

The Paloma PH-12 hot water heater 50 is automatically ignited by water flowing therethrough, and automatically extinguishes itself (except for a pilot) when such flow stops. Water accordingly flows through, and is heated by, heater 50 when pump 56 is energized. After being heated, water from outlet 52 of heater 50 flows through discharge line 18 and now open valve 39 to the inlet 38 of heat exchanger 36 in hot water storage tank 28, through the heat exchanger, and then from outlet 40 to the return line 26 of heater system 10 and back to heater inlet 54. Typically, the water is heated about 40° F. to 50° F. during each pass through heater 50, and most of this heat is given up or lost as it flows through heat exchanger 36 and back to heater inlet 54. The zone control valves of house heating system 12 are normally closed so that, unless one of the zones is calling for heat as discussed hereinafter, all of the heated water from discharge 18 will flow through hot water heating system 14 and none will flow through house heating system 12. Balance valve 72 in bypass line 70 is partially open, set as required to provide a pressure drop or dummy load thereacross at least as great as the maximum load of hot water heater system 14 and house heating system 12.

As shown, the switch 86-1 of lower limit control 86 is mounted in series with inverter 118 and the control senses the temperature of water at well 82 in return line 26. If the temperature exceeds the set point of control 86, in the illustrated embodiment about 170° F., switch 86-1 automatically opens, stopping the flow of current through inverter 118 and permitting normally-open safety bypass control valve 76 to open. With valve 76 open, water from pump 56 will flow through bypass conduit 74 rather than through heater 50, and heater 50 will automatically be extinguished. Switch 86-1 remains open until the sensed temperature in return line 26 drops to 5° F. below the set point of control 86, in the disclosed embodiment about 165° F., at which point the switch closes, thereby energizing and closing valve 76 and causing water again to flow through and be heated in heater 50.

Pump 56 will continue to force water through heater 50 (or bypass conduit 74) and hot water heating system 14 until the temperature of the domestic hot water in tank 28 reaches the desired level. Switch 48-1 of aquastat 48 then will open, stopping flow of current to valve 39 and relay coil 110-1 and thereby closing 39, opening relay contacts 110, and turning off pump 56. Pump 56 will also be turned off if, at any time, the temperature of water in control well 80 in discharge line 18 exceeds a predetermined upper set point, generally about 220° F. This temperature is sensed by upper limit control 84, the switch 84-1 of which automatically opens at 220° F. and remains open until the sensed temperature drops below 195° F., at which point it automatically closes.

The operation of the control circuits 124-A, 124-B and 124-C of the zones 12-A, 12-B and 12-C of heating system 12 is similar. For example, the switch of thermostat 126-B in zone 12-B closes when the sensed house temperature in the zone B drops below the thermostat's lower set point, thereby permitting current flow through control circuit 124-B, energizing the coil 114-1 of relay 114 and the control of zone control valve 22-B. This opens control valve 22-B and closes the contacts of rely 114, thereby energizing pump 56 and forcing water to flow through heater 50, where it is heated, and thence to and through heating zone 12-B. Pump 56 continues to operate, and heat continues to be supplied to house zone 12-B, until the temperature sensed by thermostat 126-B reaches the thermostat's upper set point, at which point the switch of thermostat 126-B opens, closing zone valve 22-B and turning off pump 56. As discussed with reference to heating system 14, flow from pump 56 will be diverted through bypass 74 if the temperature of water in return 26 at any time exceeds the upper set point of lower limit control 86, and the entire system will be shut down if the temperature of water in discharge line 18 exceeds the upper set point of upper limit control 84.

Figure 3:
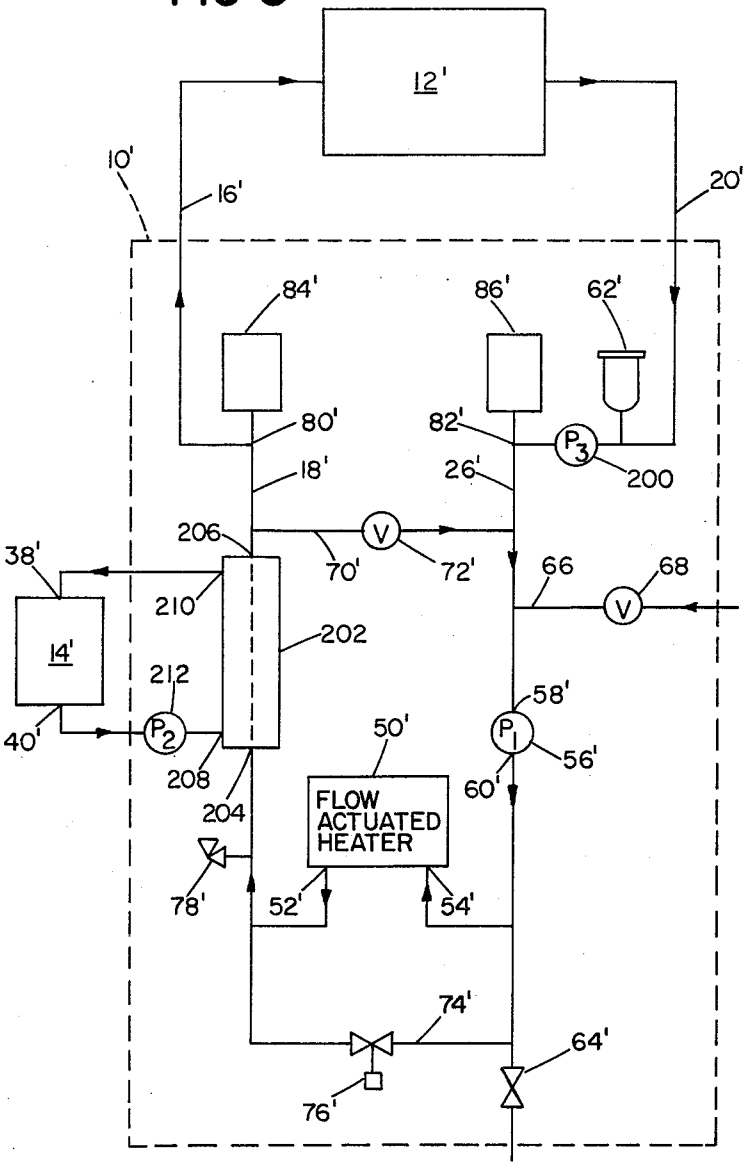
FIG. 3 is a schematic view of a modified system embodying the invention; and, FIG. 4 is a schematic view of the controls of the system of FIG. 3.

Referring now to FIG. 3, there is shown a slightly modified space and water heater system, generally designated 10', for supplying hot water to a house space heating system, generally designated 12', and a domestic hot water heating system, generally designated 14'. Systems 10', 12', and 14' are substantially similar to systems 10, 12, and 14 already described, and corresponding components thereof are identified by the same reference numerals, with a differentiating prime (') added thereto.

As before, the inlet 16' to heater system 12' is connected to the discharge line 18' of heating system 10' and the outlet 20' of system 12' is connected to return line 26' of heater system 10'. Similarly, hot water system 14' has an inlet 38' and an outlet 40 and includes a generally conventional insulated storage tank in which water is heated by a hot water coil.

Heater system 10' includes a Paloma tankless gas hot water heater 50' having its main outlet 52' connected to discharge line 18' and its main inlet 54' connected to return line 26'. Main pump 56' in return line 26' has its inlet 58' connected to heating system outlet 20' and its outlet 60' to heater inlet 54'; bypass conduit 70' including balance valve 72' is connected between discharge line 18' and return line 26' in parallel with and between main heater 50' and house heating system 12'; and safety bypass 74' including control valve 76' is connected in parallel with and between inlet 54' and outlet 52' of heater 50. A secondary system pump 200 is provided in return line 26' between control well 82' and the point of connection of relief valve 62' to provide the additional head required when the load of system 12' is too great for main pump 56' alone.

A heat exchanger 202 is mounted in discharge line 18' between the outlet 52' of main heater 50' and the point of connection of bypass conduit 70'. The inlet 204 and outlet 206 of main flow path through the heat exchanger are connected in discharge line 18'; the inlet 208 and outlet 210 of the secondary flow path to, respectively, the outlet 40' and inlet 38' of hot water heating system 14'. A domestic hot water pump 212 is mounted between domestic hot water system outlet 40' and heat exchanger secondary inlet 208 to cause water to circulate through the hot water coil in the tank of domestic hot water system 14' and the secondary flow path of heat exchanger 202.

Figure 4:
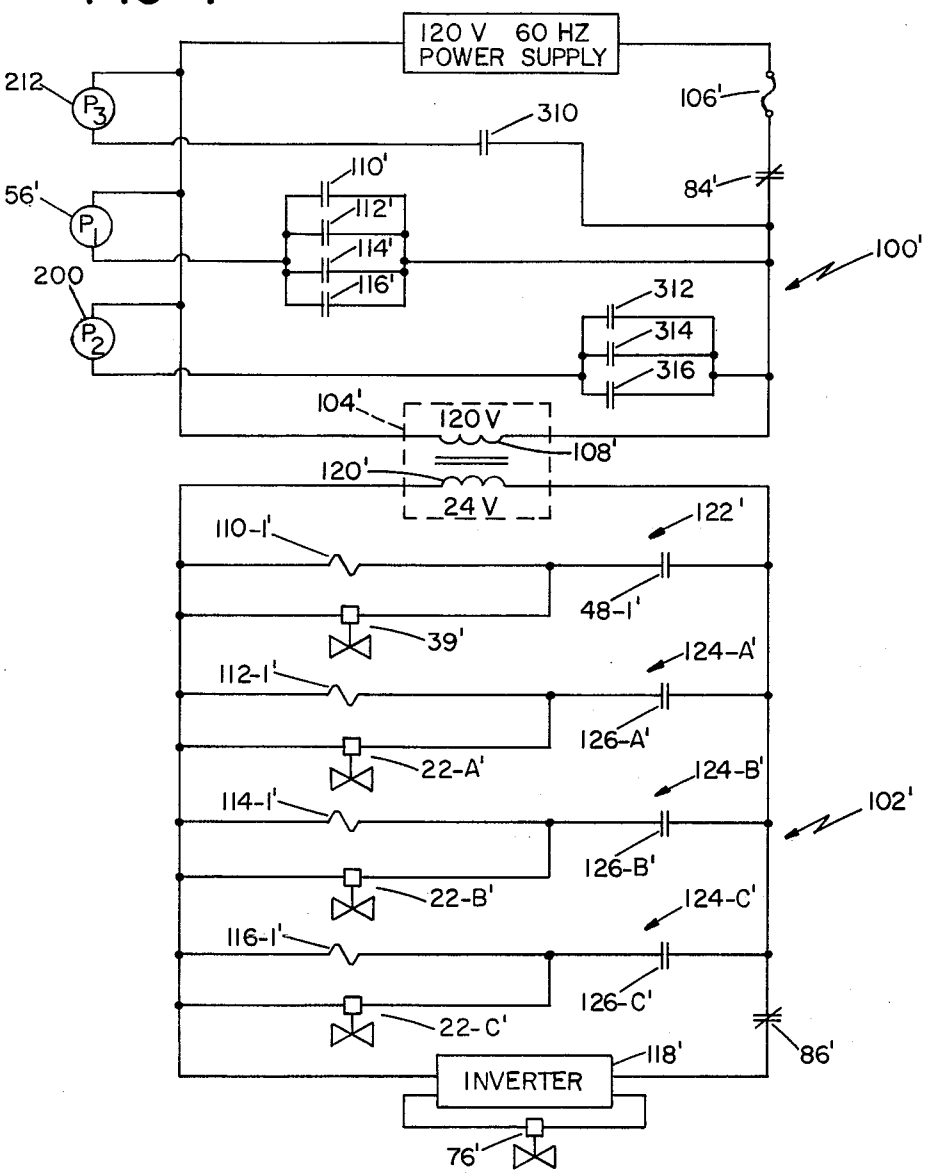

The control system for the system of FIG. 3 is illustrated in FIG. 4 and includes a 120 volt a.c. power loop 100' and a 24 volt a.c. control loop 102', the two loops being linked through a transformer 104'. The control loop 102' is identical to control loop 102 shown in FIG. 2. Portions of power loop 100' are similar to corresponding portions of power loop 100 of FIG. 2 and are identified using the same reference numerals with a differentiating prime (') added. As shown, each of pumps 200 and 212 is connected across the main 120 volt power supply in parallel with pump 56'. The control circuit for hot water pump 212 includes a normally open switch 310 controlled by relay coil 110-1'. The control circuit for secondary system pump 200 includes three parallel-connected normally open switches, designated 312, 314, and 316, and controlled by a respective one of relay coils 112-1', 114-1', and 116-1'. It accordingly will be seen that pump 212 will be energized whenever the domestic hot water aquastat 48' of heater system 14' has closed switch 48-1' of control current 122', and that pump 200 will run when the thermostat in one of control currents 124-A', 124-B', or 124-C' has been tripped.

As will be apparent to those skilled in the art, the system of the present invention may be modified in other respects, and may be constructed using a wide range of conventional components other than those described above. For example, a gas heater having a conventional thermostatically controlled ignition, such as the Potterton Netaheat heater made by the Potterton Boiler Co. of Great Britain, may be used in lieu of the Paloma heater of the above-described embodiments by eliminating bypass conduit 74 and connecting low limit control 82 to the heater ignition system rather than to bypass control valve 76. This and other modifications will be within the scope of the following claims.

What is claimed is:

1. A heater system adapted for connection to both space and domestic water heating systems comprising:
   - a main water discharge and main water return:
   - a main water heater having a water inlet and a water outlet and operative for heating water flowing therethrough;
   - a main pump connected in series with said main heater between said discharge and return;
   - a bypass conduit connected across said main pump and main heater in parallel with said main discharge and return;
   - a balance valve mounted in said bypass conduit; and,
   - a control system adapted for connection to each of said space and domestic water heating systems and operative to activate the main pump and cause the main heater to heat water flowing therethrough and to cause heated water to flow through a respective one of said space and domestic water heating systems when the temperature sensed by a temperature sensing control in said respective one is below a respective predetermined temperature level,
   - said balance valve being effective to maintain a dummy load thereacross.

2. The system of claim 1 including a heat exchanger having a primary inlet and primary outlet serially connected between said main heater and said discharge and a secondary inlet and outlet adapted for serial connection with a heating coil in said domestic water heating means, and wherein said control system is responsive to a sensor for sensing the temperature of water in the storage tank of said domestic water heating means to actuate said main pump and cause water heated by said main heater to flow through said heat exchanger and said bypass conduit and to cause water to flow through said heating coil and said heat exchanger between said secondary inlet and secondary outlet thereof.

3. The system of claim 1 including a sensor for sensing the temperature of water is said return and means responsive thereto for causing water to flow from said return through said main pump to said discharge without being heated by said heater when the said temperature of water in said return exceeds a predetermined level.

4. The system of claim 3 wherein said means is operative for deactivating said main heater when said temperature of water in said return exceeds said predetermined level.

5. The system of claim 3 wherein said means includes a heater bypass conduit connected in parallel with said main heater and a control valve responsive to said sensor for sensing the temperature of water in said return for permitting flow thorugh said heater bypass conduit when said temperature of water in said return exceeds said predetermined level.

6. The system of claim 5 wherein said control valve is biased towards its open position and is responsive to said control system such that said pump will cause water to flow through said main heater only when said temperature of water in said return is below its said predetermined level.

7. The system of claim 1 including a sensor arranged to sense the temperature of water in said discharge and operative to deactivate said main pump when said temperature of water in said discharge is above a predetermined level.

8. The system of claim 1 wherein said space heating system is connected to and between said discharge and said return and including a secondary pump connected in series with said main pump and to said control system and responsive to said temperature sensing control of said space heating system.

9. The system of claim 8 including a domestic water pump serially connected with said domestic water heating means and responsive to said temperature sensing control of said domestic water heating means.

10. A heater system comprising:

a main water discharge and a main water return adapted for connection to space or domestic water heating means;

a main water heater having a water inlet and a water outlet and responsive to flow of water therethrough to ignite said heater and heat water flowing therethrough;

a bypass conduit connected in parallel with said main heater;

a main pump serially connected with said main water heater and said bypass conduit;

valving for causing water from said pump to flow through a selected one of said main water heater and said bypass conduit;

a control system adapted for connection to said space or domestic water heating means and operative to activate said main pump and cause water to flow through said main heater whereby said heater heats water flowing therethrough in response to a temperature sensing control in said space or domestic water heating means; and, a first safety control including a first sensor arranged to sense the temperature of water in one of said return and said discharger and means responsive to said first sensor and operatively connected to said valving for causing water flowing from said return to said discharge to flow through said bypass conduit rather than said main heater and thus not to be heated by said main heater when the sensed temperature of said water is above a first predetermined level.

11. The system of claim 10 wherein said first safety control senses temperature of water in said return, and including a second safety control comprising a second sensor engaged to sense the temperature of water in said discharger and means responsive to said second sensor for deactivating said pump, thereby causing flow of water through and extinguishing said main heater, when the sensed temperature of water in said discharger is above a second predetermined level.

12. The system of claim 11 including a normally open control valve in said bypass conduit and wherein said control means is operative to close said valve when said sensed temperature of said water in said discharge and return are respectively below said first and second predetermined levels and to permit said valve to open when either of said sensed temperatures is above the respective one of said predetermined levels.

13. The system of claim 10 including a normally open control valve in said bypass conduit and wherein said control means is operative to close said valve when said sensed temperature of said water in said one of said discharger and return is below said first predetermined level.

* * * * *